United States Patent [19]

Warren et al.

[11] 4,259,910

[45] Apr. 7, 1981

[54] ELECTRIC CONTROLLED AIR INCINERATOR FOR RADIOACTIVE WASTES

[75] Inventors: Jeffery H. Warren; Harry E. Hootman, both of Aiken, S.C.

[73] Assignee: The United States of America as represented by the United States Department of Energy, Washington, D.C.

[21] Appl. No.: 58,420

[22] Filed: Jul. 18, 1979

[51] Int. Cl.[3] ..... F23B 5/00; F23C 9/00; F23G 7/06

[52] U.S. Cl. ..... 110/211; 110/214; 110/237; 110/250

[58] Field of Search ..... 110/210, 211, 237, 250, 110/214, 203, 345

[56] References Cited

U.S. PATENT DOCUMENTS

| | | | |
|---|---|---|---|
| 830,974 | 9/1906 | Decarie | 110/210 |
| 3,259,083 | 7/1966 | Evans | 110/210 |
| 3,496,890 | 2/1970 | La Rue | 110/210 |
| 3,808,986 | 5/1974 | Logdon | 110/210 |
| 3,848,548 | 11/1974 | Bolejack et al. | 110/237 |
| 3,922,974 | 12/1975 | Hempelmann | 110/237 |
| 4,091,747 | 5/1978 | Chase | 110/210 |

*Primary Examiner*—Edward G. Favors

*Attorney, Agent, or Firm*—Allen F. Westerdahl; Raphael V. Lupo; James E. Denny

[57] ABSTRACT

A two-stage incinerator is provided which includes a primary combustion chamber and an afterburner chamber for off-gases. The latter is formed by a plurality of vertical tubes in combination with associated manifolds which connect the tubes together to form a continuous tortuous path. Electrically-controlled heaters surround the tubes while electrically-controlled plate heaters heat the manifolds. A gravity-type ash removal system is located at the bottom of the first afterburner tube while an air mixer is disposed in that same tube just above the outlet from the primary chamber. A ram injector in combination with rotary magazine feeds waste to a horizontal tube forming the primary combustion chamber.

25 Claims, 11 Drawing Figures

ELECTRIC CONTROLLED AIR INCINERATOR FOR RADIOACTIVE WASTES

FIELD OF THE INVENTION

The invention relates to incinerators for solid wastes and, more specifically, to an improved incinerator particularly adapted for the burning of relatively small volumes of radioactive wastes.

BACKGROUND OF THE INVENTION

Prior art ceramic-type waste incinerators are generally built employing two basic construction techniques, viz., the use of refractory bricks and the use of prefabricated refractory-lined steel pipes. Both techniques suffer from the very basic disadvantage that the resultant structure is very massive and heavy. In this regard, in refractory brick constructions provision is normally made for maintaining a compressive stress on the bricks and to this end, the refractory brick is often back-filled with castable refractory to ensure the elimination of voids between the brick and the steel support housing. The second technique requires the use of large pipe diameters to contain the firebrick and insulation linings. Moreover, because of conventional pipe elbow designs, it is difficult to create a compact path or labyrinth in order to increase the gas residence time of the combustion chambers of such incinerators. Further, highly trained kiln masons are required to construct and assemble incinerator structures of both types. Additionally, both types are difficult to heat because of their large thermal inertia, and heater installation and repair is difficult and expensive.

Examples in the patented art of incinerators for radioactive wastes include those disclosed in U.S. Pat. Nos. 3,922,974 (Hempelman) and 4,091,747 (Chase). Other patents of possible interest include U.S. Pat. Nos. 3,496,890 (LaRue) and 3,808,986 (Logdon) although, of course, this listing obviously is not, nor is it represented to be, in any way exhaustive.

SUMMARY OF THE INVENTION

In accordance with the invention, an incinerator or furnace is provided which is particularly adapted for use in burning small volumes (5 to 10 kg/hr) of solid wastes containing up to 500 Ci/m$^3$ of transuranic contamination. However, while the invention will be discussed in terms of such a use, the invention is clearly not limited to this use and it will be appreciated that the various advantages of the incinerator of the invention make it attractive for use in many different areas. Briefly considering some of the more important advantages, the incinerator of the invention is compact and is relatively lightweight as compared with the prior art. Moreover, the assembly thereof is greatly simplified as compared with prior art constructions and the need for highly skilled personnel is virtually eliminated. Further, the incinerator construction, despite the compactness thereof, provides for a long combustion gas residence time and the heating arrangement provides relatively high temperatures (600° to 1000° C. for a specific example). These temperatures, in combination with a controlled addition of air, give minimum ash entrainment, and together with the long residence time referred to, result in approximately $10^9$ off-gas decontamination factors when using conventional off-gas cleaning equipment. The incinerator or furnace construction also permits ready disassembly and disposal of the contaminated components when the incinerator is decommissioned.

In accordance with a preferred embodiment, a furnace construction is provided which comprises, in combination, a primary combustion chamber, a plurality of generally vertical refractory tubular members disposed in spaced parallel relationship, one of the vertical members being disposed adjacent to the primary combustion chamber and in communication therewith so as to receive combustion gases therefrom, and a plurality of cast refractory manifolds connecting the tubular members together to form an afterburner chamber which defines a continuous tortuous path for the combustion gases. As mentioned above, a long residence time is provided for the off-gas (approximately 5 seconds for a typical flow rate of 45 SCFM) so as to burn off any carbon particulates and this residence time combined with the flow reversals of the tortuous path ensure a particulate-free exhaust gas.

The primary combustion chamber of this two-stage furnace preferably comprises a generally horizontal refractory tubular member. Both stages are housed within a sealed shell or housing and insulation is provided between the shell and the chambers. The vertical tubular members of the afterburner chamber are sealed under the compressive loading of the vertical tubular members in conjunction with the manifolds. A refractory cast primary inlet chamber located at the bottom of the first tubular member, i.e., the one directly connected to the primary combustion chamber, includes an ash removal assembly for enabling removal of ash from the products of combustion of the primary combustion chamber.

An important feature of the invention concerns the construction of the manifolds. Specifically, because of their size and weight, manifolds are constructed of at least two separately cast individual portions, one of said portions including a pair of apertures therein in which the ends of a pair of said tubular members are received. Advantageously, the manifolds are constructed of three portions with a further one of said portions including a connecting chamber providing communication between the pair of tubes and the three portions being stacked vertically and being joined by ship-lap joints. Another one of the portions of the manifold includes a removable port or plug received therein so as to permit inspection and cleaning of the associated tubular members. This removable port preferably includes a sight glass for viewing the tubular members. The ports may be removed entirely and replaced by an exhaust pipe which is disposed in the manifold in communication with the associated tubular member. Sight glasses may be removed to provide a connection to an oxygen analyzer or a relief valve.

Heating for the furnace is preferably provided by electrically controlled girdle heaters which surround the tubular members. In addition, electrically controlled plate heaters for heating the manifolds are also provided. The heaters are advantageously spaced from the surfaces of said manifold which are being heated so as to increase heater life. Electrical heating provides intrinsic safety advantages with transuranic, highly contaminated wastes.

The furnace construction of the invention also includes a feeding means for feeding waste material to the furnace. This feeding means including a ram assembly for injecting waste into the primary chamber. The ram assembly includes a ram body having a longitudinally extending prow extending outwardly from the front thereof. A motor arrangement is provided for moving the ram body longitudinally and for rotating the ram body. The means further comprises a rotary magazine feeder and a double valve loading mechanism for feeding waste to the ram assembly. A plurality of fluid inlets are located between the magazine feeder and the ram assembly for adding air, steam and/or nitrogen to the waste. The ash-removal assembly is disposed beneath the first tubular member and includes a storage chamber and isolation valve means for controlling the transfer of solid products of combustion from the primary combustion chamber relative to the storage chamber. In particular, ash removal is controlled by gravity flow through a pair of knife-type isolation valves.

In a preferred embodiment, an air mixing means is located in one tubular member for mixing air with the gases from the primary combustion chamber. The air mixing means advantageously comprises a housing having an inner perforate conical shell mounted therein with the small end of the cone disposed toward the primary combustion chamber, in combination with air lines for feeding air into the housing.

The incinerator is operated with lower than ambient air pressure to ensure that the only air leakage is into the outer shell and to minimize the escape of radioactive contamination. A draft is maintained using an external blower placed after conventional off-gas quenching and neutralizing scrubber equipment and high efficiency particulate air filtering.

Other features and advantages of the present invention are stated in or are apparent from the detailed description of a presently preferred embodiment of the invention found hereinbelow.

DESCRIPTION OF THE PREFERRED EMBODIMENTS

Figure 1:
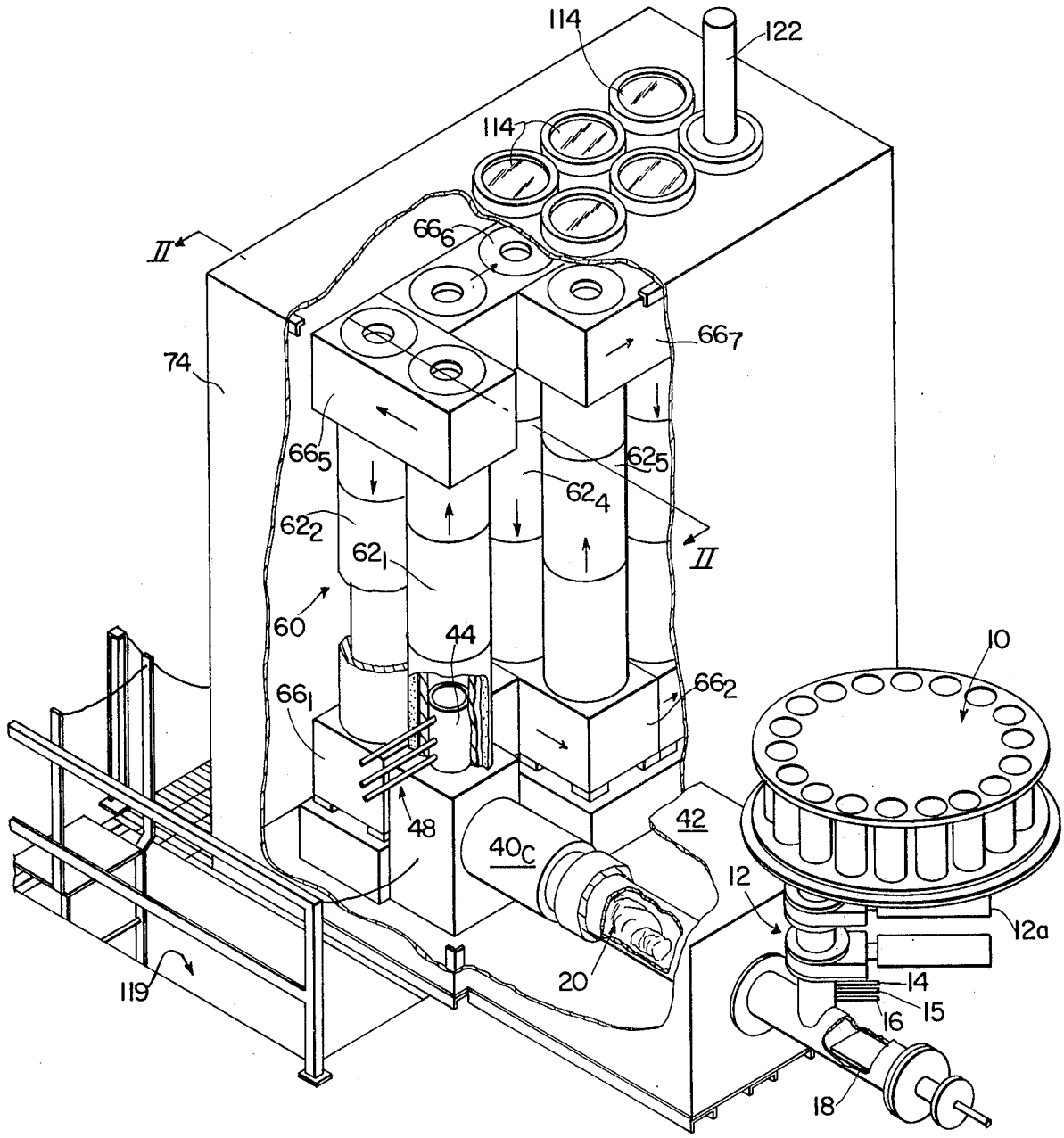
FIG. 1 is a perspective view, partially broken away, of an incinerator or furnace constructed in accordance with a presently preferred embodiment of the invention.

Referring to FIG. 1, a waste incinerator system in accordance with the invention is shown. The input portion of the system basically comprises a rotary magazine 10 which cooperates with a loading assembly 12 including a double valve loading mechanism **12*a* and inlets 14, 15 and 16 which constitute a pressure tap, an air nitrogen inlet and a steam inlet, respectively, for delivering the waste material to an input ram 18. The ram 18 is adapted to feed the waste material to a primary chamber 20** of the incinerator.

In the specific exemplary embodiment under consideration the solid waste to be incinerated is shredded and packaged in 300-gram batches in cylindrical paper containers 9 inches long and 4 inches in diameter. Each container is then inserted into one of the eighteen positions provided in the rotary feed magazine 10. One package is fed automatically into the primary chamber 20 about every 3 minutes. The double-valve mechanism **12*a* ensures safety and containment, and is designed to maintain a vacuum up to 15 to 20 inches of water inside the incinerator operation. The package is then automatically rammed into the primary chamber 20 by the ram 18 which is preferably fabricated of an Inconel® 601 (Huntington Alloys, Inc.). In the specific embodiment referred to, the loading mechanism 12 is fabricated of Type 304 stainless stell with Type 316 stainless steel valves while the rotary feed magazine 10** is aluminum.

Figure 5:
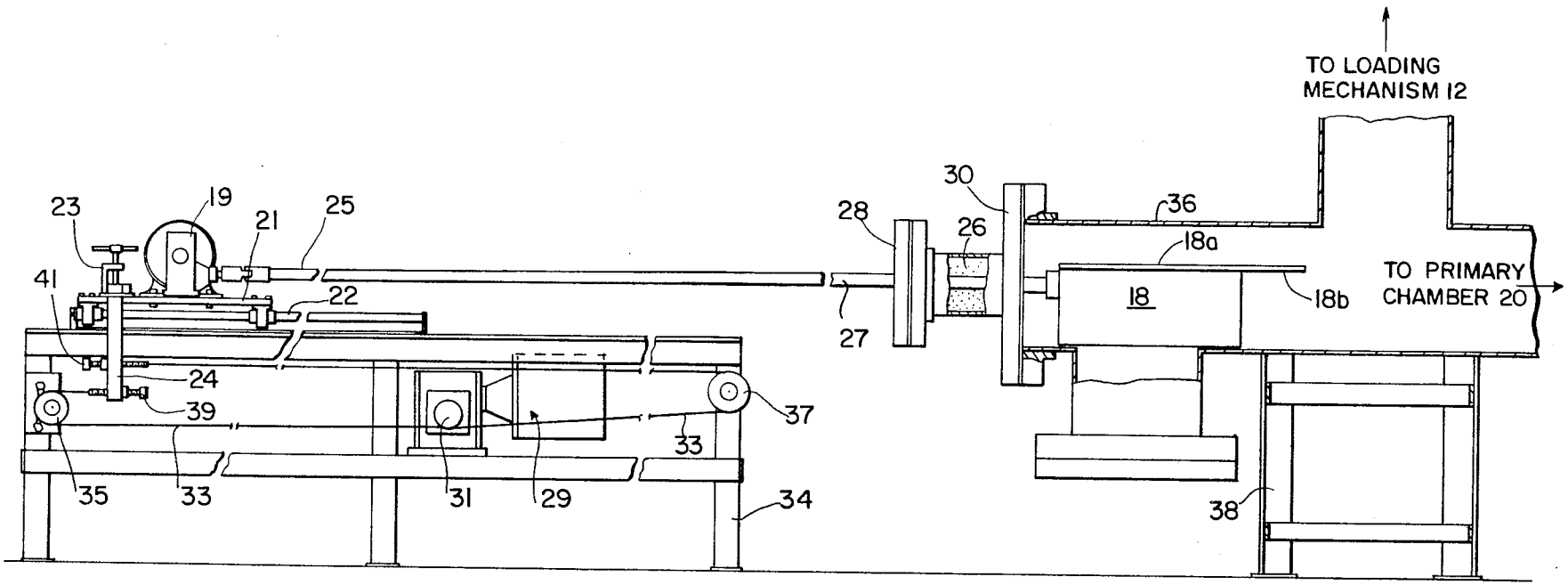
FIG. 5 is a side elevational view of the ram subassembly of the incinerator of FIG. 1.

As illustrated in FIG. 5, a cable and motor drive is used to move ram 18 back and forth. This drive includes a motor 19 mounted on a dolly 21 which moves along a track, generally denoted 22, and which carries an upstanding connector bracket 23 and a downwardly depending cable connector 24. A shaft 25 is directly coupled from the motor 21 to a rod 27 for insertion into the hot primary chamber 20. The rod 27 is sealed in relation to chamber 20 by a Fiberfrax® (Carborunum Co.) packing 26 disposed between a pair of spaced flanges 28 and 30. The ram 18 is constructed with a flat **18*a* on the top thereof and a prow 18*b* which extends outwardly therefrom, the prow 18*b* serving to stir the waste so as to aid in pyrolysis. A further drum drive motor assembly 29, including a gear motor and a "Boston gear", serves as a drive for a drum 31. As illustrated, a cable 33 extends from drum 31 in opposite direction around a pair of sheaves 35 and 37 located at opposite ends of a support table 34. The cable passing around sheave 35 is connected to connector 24 by a connector bolt 39 located at the lower end thereof while the cable passing around sheave 37 is also connected to connector 24 by a further connector bolt 41 located just above the other connection. Thus, rotation of drum 31 provides controlled movement of motor 19 and associated dolly 21 along track 22**.

The primary chamber 20 is a horizontally extending cylindrical unit preferably fabricated of silicon carbide and electrically heated to 600° to 900° C. In a specific embodiment, primary chamber 20 is made of Refrax 20 (Carborundum Co.), a silicon nitride-bonded silicon carbide. In this embodiment, chamber 20 is 66 inches long, with an inner diameter of 8.5 inches and an outer diameter of 11.0 inches. The entire primary chamber is surrounded by 10 inches of Fiberfrax® insulation and a ¼ inch thick steel shell. The electrical heating of chamber 20 is accomplished with easily replaceable tubular girdle heaters 40 providing a total of 4.8 kW. The heaters 40 are divided into three separately controllable groups **40*a*, 40*b*, 40*c* to maintain a temperature gradient in the primary chamber, so that a package of waste material is not pyrolyzed before it leaves the loading zone of the primary chamber 20. Air enters the primary chamber at the loading mechanism through inlet 15 to reduce the carbon content of the ash, but in less than stoichimetric amounts so as not to entrain the ash in the pyrolysis gas. The primary chamber 20 is housed within an enclosure 42 and blanket insulation (not shown) is used to fill the voids between the inner wall of the enclosure and the outer walls of the chamber 20**.

Figure 2:
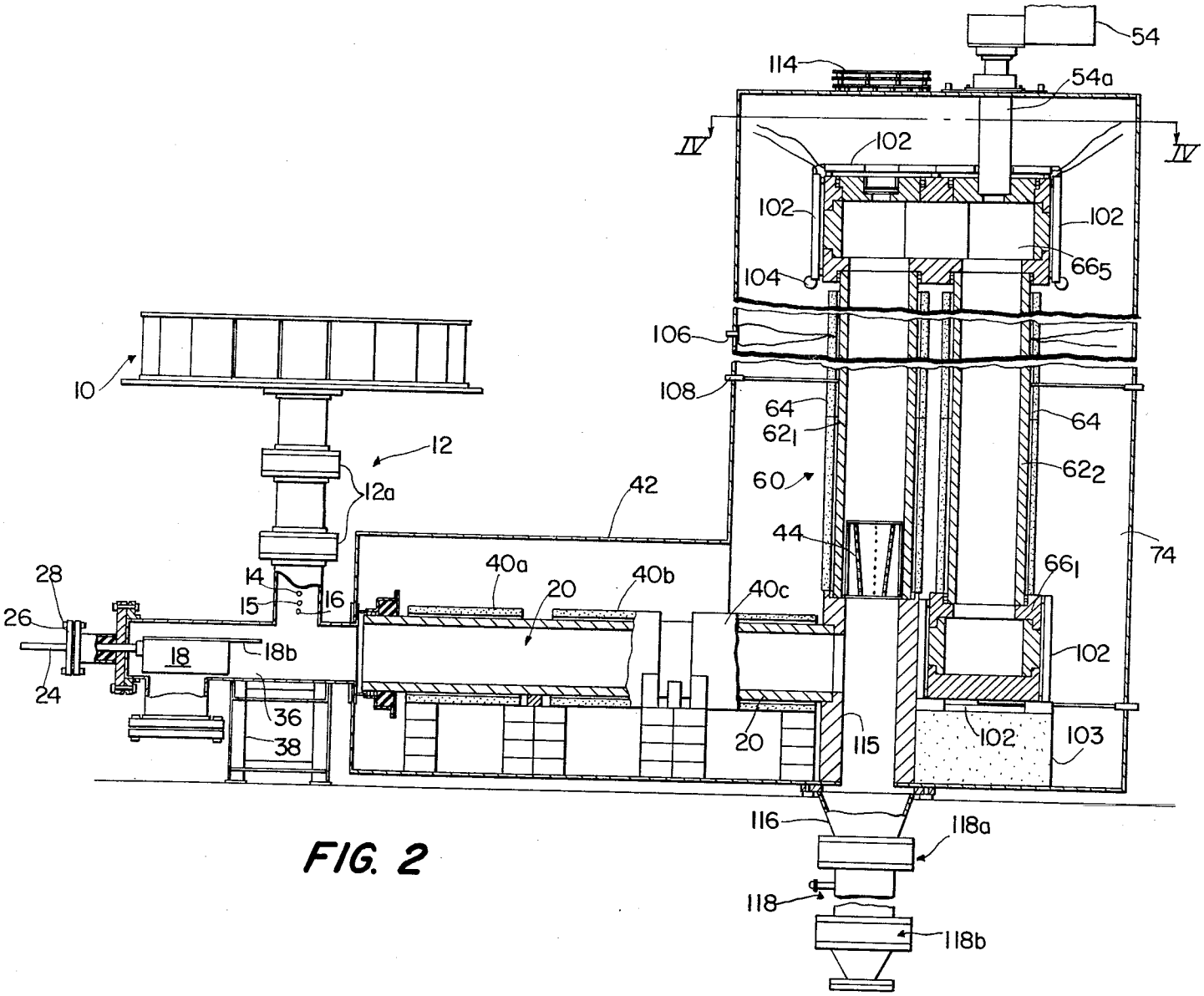
FIG. 2 is a cross-sectional view taken generally along line II—II of FIG. 1, through the midplane of the primary chamber.
Figure 6:
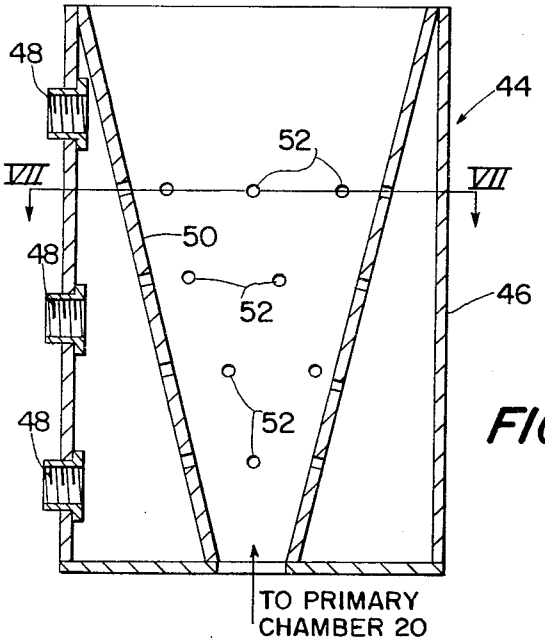
FIG. 6 is a longitudinal cross-sectional view of the air mixing chamber of the incinerator of FIG. 1.
Figure 7:
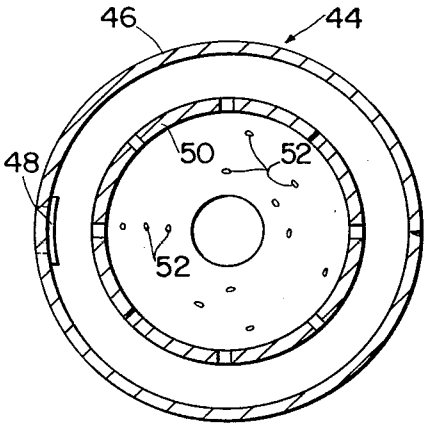
FIG. 7 is a cross-sectional view taken generally along line VII—VII of FIG. 6.

A vertically oriented air mixing chamber or air mixer 44 communicates directly with the primary chamber 20, as can best be seen in FIGS. 1 and 2. The details of construction of a preferred embodiment of the air mixer 44 are shown in FIGS. 6 and 7. The air mixer 44 includes an outer cylindrical wall or shell 46 which is connected to a plurality of air lines 48, the latter being disposed along one side of shell 46 in vertically spaced relationship. An inner, generally conical wall or shell 50 is mounted within outer shell 46 and includes a plurality of air inlet nozzles 52 formed therein, as illustrated. Nozzles 52 are formed by ¼ -inch-diameter holes in a specific embodiment. The small end of conical shell or burner cone 46 is disposed so as to communicate with primary chamber 20. The air mixer 44 receives the pryolysis gas from chamber 20 along with 100% to 200% excess air to initiate burning of the gas. The air flow to mixer 44 is preferably controlled by an automatic air supply (not shown) with feedback from an oxygen analyzer 54 (see FIGS. 2 and 3) whose probe (not shown) is located in the top of a second afterburner pipe described below.

Figure 8:
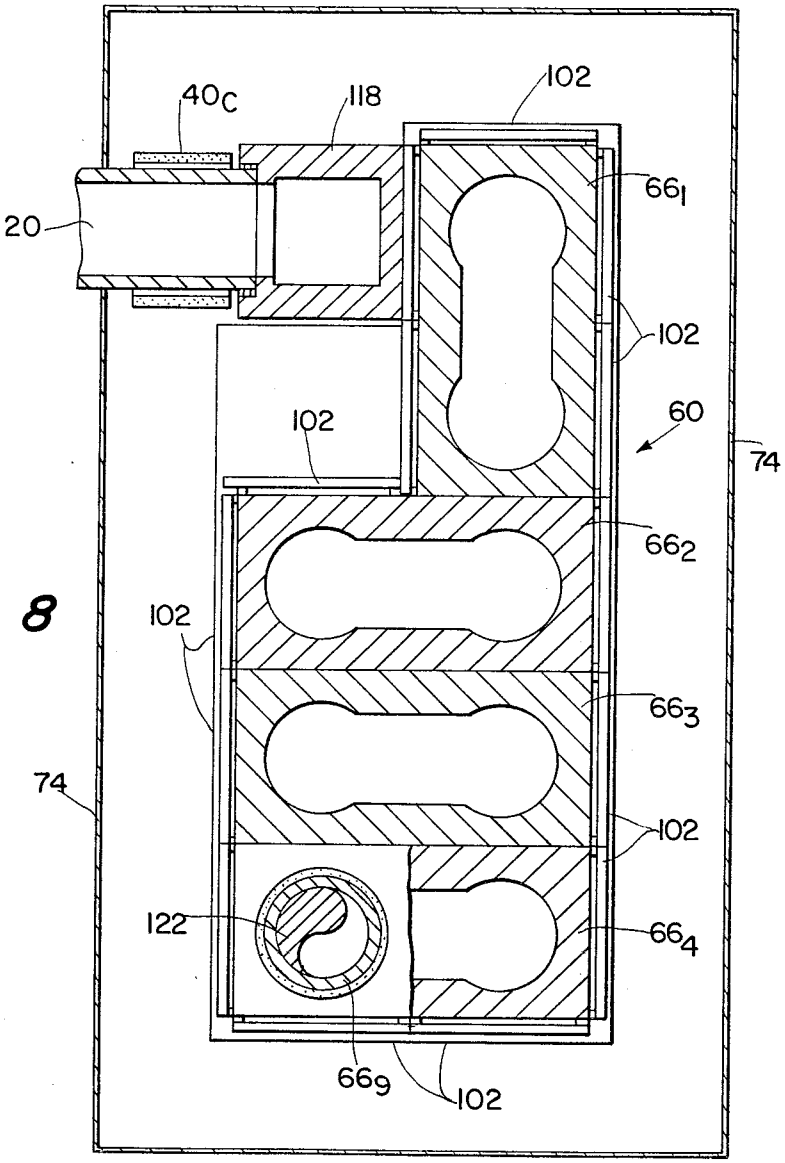
FIG. 8 is a horizontal cross-sectional view, partially broken away, of the bottom manifolds of the afterburner of the incinerator of FIG. 1.
Figure 9:
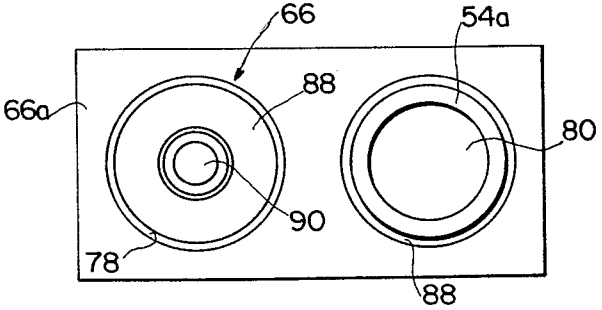
FIG. 9 is a plan view of one of the manifolds of FIG. 1.
Figure 10:
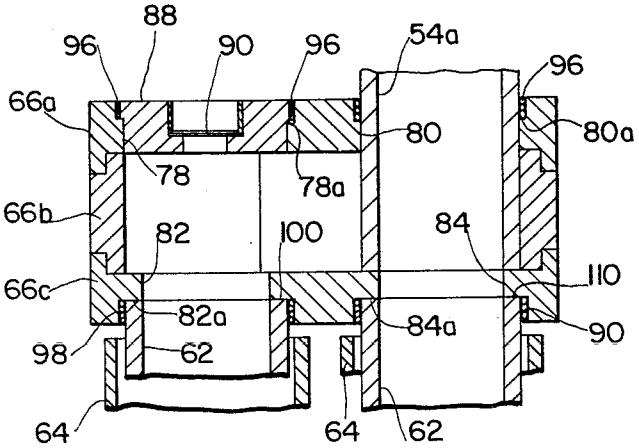
FIG. 10 is a cross-sectional view of the manifold of FIG. 9.

The construction of the afterburner chamber constitutes a very important feature of the invention, the arrangement and components of construction being illustrated in FIGS. 8 to 10 in addition to FIGS. 1 to 4. In the specific embodiment under consideration, the afterburner chamber, which is generally denoted 60, is formed by nine tubes collectively denoted 62 and individually denoted $62_1$ to $62_9$. The tubes are fabricated of "Cerox" 700 (Babcock and Wilcox Co.) 90% alumina. The tubes 62 are heated individual tubular girdle heaters 64 each of which surrounds a corresponding tube 62 and extends along the entire length thereof. The tubes 62 cooperate with corresponding manifolds 66 to form a tortuous yet compact chamber.

Figure 4:
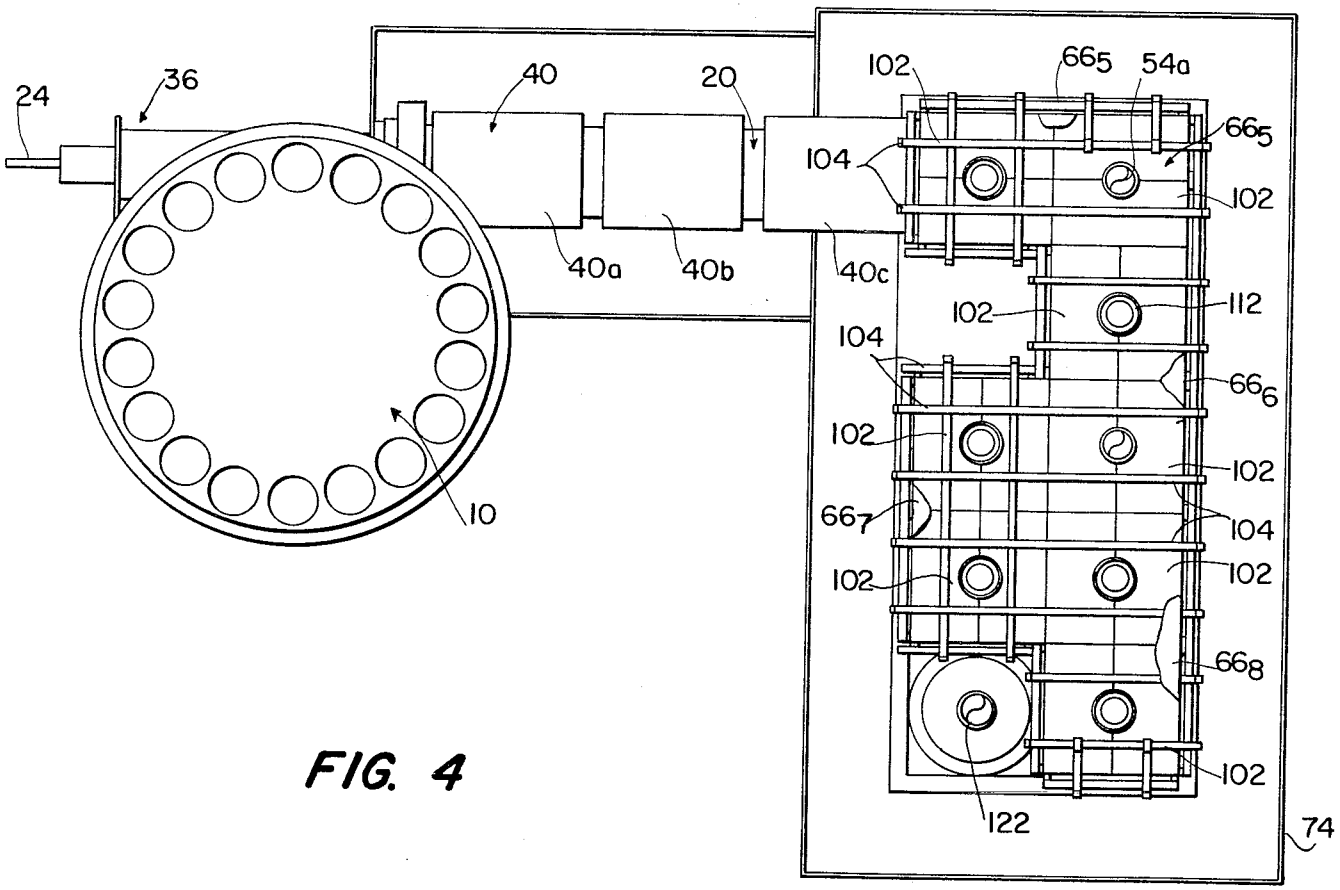
FIG. 4 is a plan view, partially broken away, of the incinerator of FIG. 1.

The manifolds 66 each comprise a generally rectangular member having a pair of spaced openings therein which are interconnected by a connecting chamber. This pair of openings receives a corresponding pair of tubes 62 and thus a connecting path is formed between the two tubes through the pair of manifold openings and the connecting member. FIG. 8 shows the four lower manifolds 66 of the afterburner chamber. The manifolds are individually denoted $66_1$ to $66_4$ with manifolds $66_2$ to $66_6$ extending orthogonal to manifold $66_1$ as shown. Manifolds $66_1$, $66_2$, $66_3$, and $66_4$ are respectively adapted to receive pairs of tubes $62_2$ and $62_3$, $62_4$ and $62_5$, $62_6$ and $62_8$ and $62_9$. As can best be seen in FIG. 1 and FIG. 4, there are also four upper manifolds $66_5$ to $66_8$. In FIG. 4, parts of the heating plates described hereinbelow are broken away to show the manifolds. As illustrated, manifold $66_5$ extends transversely while manifolds $66_6$, $66_7$ and $66_8$ extend logitudinally in staggered relationship. The manifolds $66_5$ to $66_8$ are oriented with respect to the lower or bottom manifolds $66_1$ to $66_4$ such that a continuous path is provided through tubes 62 and manifolds 66. Thus, referring to FIG. 1 and assuming that the air lines 48 enter through the front wall of the outer steel incinerator shell 74, waste gas from the primary chamber 20 passes up tube $62_1$, across upper manifold $66_5$, down tube $62_2$, rearwardly through bottom manifold $66_1$, up tube $62_3$ (not seen in FIG. 1), rearwardly through upper manifold $66_6$, down tube $62_4$, across manifold $66_2$ up tube $62_5$ and so on.

Figure 11:
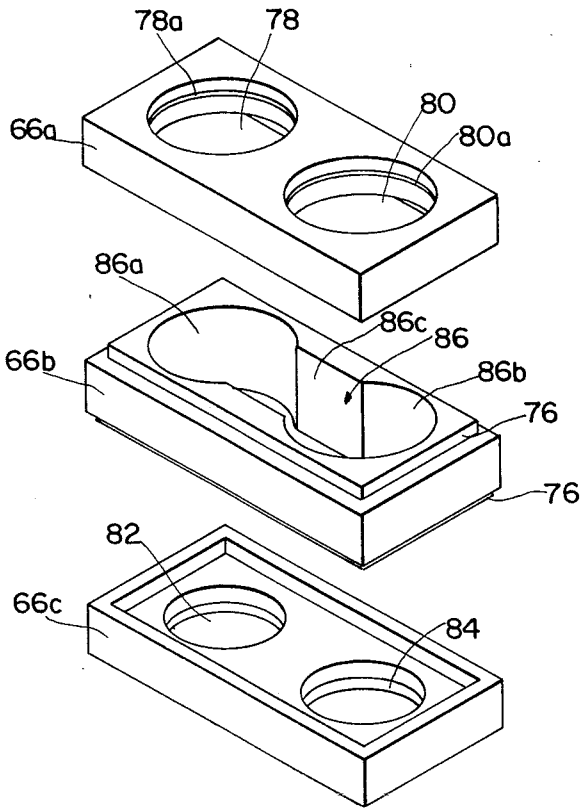
FIG. 11 is an exploded perspective view of a representative manifold unit.

Referring to FIGS. 9,10 and 11, it will be seen that each manifold 66 is formed from three separate parts because the manifolds are too large to cast and cure as a unit. The three parts, denoted 66*a*, 66*b* and 66*c*, are also cast from "Cerox" 700 and shiplap joints indicated at 76 are provided to join the parts together. Referring to FIG. 11, the upper and lower parts 66*a* and 66*c* each include a pair of apertures denoted 78 and 80 and 82 and 84, respectively, while the central part 66*b* includes a single dumbbell shaped opening 86 including a pair of circular portions 86*a* and 86*b* and a connecting portion 86*c*. It will, of course, be understood that openings 78, 86*a* and 82 combine to form the one of the manifold openings referred to above, openings 80, 86*b* and 84 combine to form the outer of the manifold opening, and connecting portion 86*c* corresponds to the aforementioned connecting chamber.

As perhaps can best be seen in FIG. 9, the openings 78 and 80 include a step 78*a* and 80*a*, respectively, in which a removable port may be received. Such as removable port is indicated in FIGS. 9 and 10 at 88 for opening 78. The port 88 includes a sight glass 90 mounted in a stepped recess therein, as illustrated in FIG. 10. An exhaust pipe may be inserted into the opening in lieu of the removable port, as indicated in FIGS. 9 and 10, with pipe 54*a* being shown. Fiberfrax ® paper gaskets are inserted in the stepped recesses prior to tube or port insertion. Pipe 55*a* is connected to oxygen analyzer 54. A similar exhaust pipe is provided for a relief valve assembly described below. A packing, indicated at 96 and preferably comprising Fiberfrax ® rope packing, is disposed between the port 88 and the corresponding wall forming opening 78 and between pipes 54*a* and opening 80. Openings 82, 84 in lower manifold part 66*c* include stepped portions 82*a* and 84*a* which abut the ends of the respective tubes 62 received therein in the openings. Rope packings 98 which are similar to packings 96 are also employed and gaskets 100, which are preferably Fiberfrax ® paper gaskets, are disposed at the ends of tubes 62, as illustrated. With this arrangement the tubes 62 are compressively sealed and in each instance the rope packing is preferably dipped in alumina silicate cement before installation. The removable ports, corresponding to port 88, permit vacuum cleaning of the afterburner and inspection of tube integrity. The sight glass 90, which is preferably quartz, permits observation of the incinerator during operation.

Figure 3:
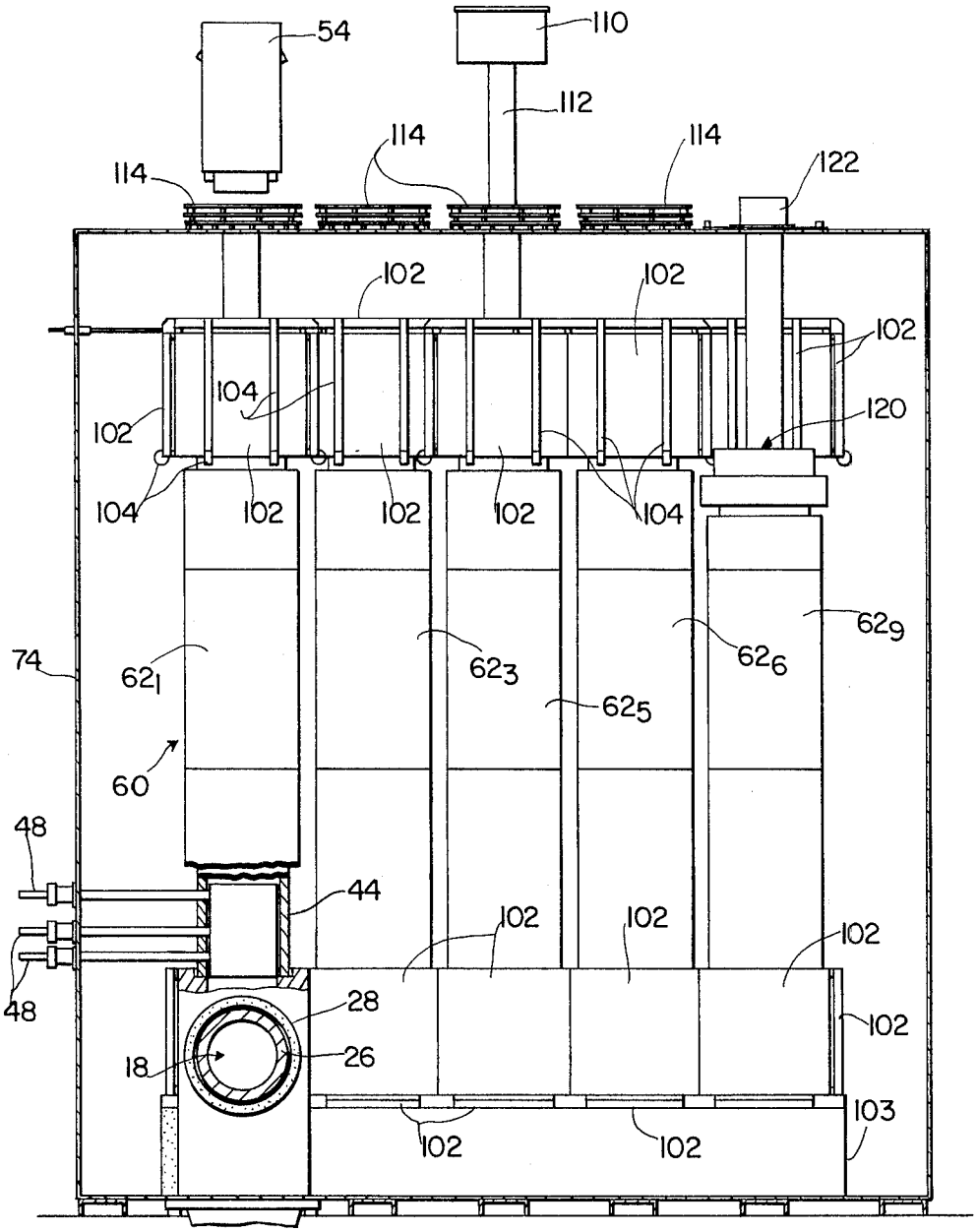
FIG. 3 is a front elevational view, partially broken away, of the incinerator of FIG. 1.

Both upper and lower manifolds 66 are heated by flat plate heaters 102, with the heaters for each manifold being separately controlled so as to provide the required heating of the pryolysis gas throughout the path of travel thereof. The manifold heaters have been omitted in FIG. 1 for purposes of clarity but as illustrated in FIGS. 2, 3 and 4, the heaters 102 are disposed on the sides and bottom of the bottom manifolds (see FIGS. 2 and 4). The lower manifolds are themselves mounted on a cast base 103 on legs which permit the insertion of a plate heater thereunder. Considering an exemplary manifold, the upper surface of manifold $66_5$ is covered by two plate heaters 102 while the exposed side surfaces are covered by four further such heaters. As shown in FIGS. 3 and 4, the flat plate heaters 102 for the upper manifold are supported by an open framework 104 formed by a plurality of "Incoloy" 800H hangers, which framework supports the side plate heaters 102 in spaced relationship to the walls of the manifolds 66. The side plate heaters 102 are actually suspended by the hangers 104 which rest on the top plate heaters 102. Preferably, the spacing or air gap provided between the heaters 102 and the heated sidewalls of the respective manifolds 66 is about a half-inch, this spacing serving to increase the heater life.

Heater wire connectors extend through steel shell 74 and are preferably formed by bulkhead connectors 106 (see FIG. 2) located on strips which are 5-inch wide and are made of National Electrical Manufacturers Association Grade G-7 continuous-filament glass bonded with silicone resin. In the specifc embodiment under consideration, the total available power from the electric heaters is 125 kW. The power provided to the primary combustion chamber 20 is 4.8 kW divided into three zones as discussed above, the power to the afterburner is 5 kW per tube 62 and the power to the plate heaters 102 is 11.4 watts/in$^2$. Thermocouple bulkhead connections 108 are also provided as is again indicated in FIG. 2.

As noted hereinabove, an oxygen analyzer 54 is located above the tubes 62 (the second tube, $62_2$, in the specific example under consideration) as is illustrated in FIGS. 2 and 4 (the latter showing the pipe connection only). A relief valve 110 is located above tube $62_5$ and a connecting pipe 112 extends through the upper wall of housing 74 as illustrated in FIG. 3. A plurality of further sight glasses 114 (see FIGS. 1 and 2) are located on the top wall of housing 74 in alignment with the sight glasses of the manifolds 66.

As shown, for example, in FIG. 2, the ash leaving primary chamber 20 falls through on ash out chamber 115 into a pipe 116 disposed below tube 66 and associated air mixer 44. An ash-out subassembly 118 is located below pipe 116. In the specific embodiment being considered, pipe 116 is preferably a tapered or conical Type 304 steel pipe and the ash-out subassembly 118 includes a pair of Type 316 stainless steel knife valves 118*a*, 118*b* spaced two feet apart. The storage chamber provided by the ash-out subassembly 118 is enough to store all of the ash produced from incinerating 5 kg/hr of waste for an eight hour day. An access pit of the ash-out subassembly is indicated in FIG. 1 at 119.

As perhaps can be best seen in FIG. 3, the final tube $62_9$ terminates in an exhaust subassembly 120 which includes an exhaust stack 122 that extends through the steel shell 74 (see also FIG. 1). The exhaust tube permits testing of the effect of varying afterburner volumes (and hence gas residence time) on exhaust gas particulates. Exhaust gases from the afterburner, after leaving exhaust stack 122, enter an off-gas cleaning system (not shown). The off-gas is cooled in a quench scrubber (not shown) and particulates are removed by further scrubbing. After neutralization of the hydrogen chloride, the gases pass through a high efficiency particulate air filter before release to the atmosphere. This off-gas treatment is conventional and thus will not be described further. As set forth above, the incinerator just described is operated at lower than ambient air pressure to ensure that the only leakage is into shell 74 and not out therefrom.

Although the invention has been described with respect to exemplary embodiments thereof, it will be understood that variations and modifications can be effected in the embodiment without departing from the scope or spirit of the invention.

We claim:

1. A furnace construction comprising, in combination:

(a) a primary combustion chamber, (b) a plurality of generally vertical refractory tubular members disposed in spaced parallel relationship, one of said vertical members being disposed adjacent to said primary combustion chamber and in communication therewith so as to receive combustion gases therefrom, and, (c) a plurality of cast refractory manifolds connecting said tubular members together to form an afterburner chamber defining a continuous tortuous path for said combustion gases.

2. The furnace construction as claimed in claim 1 wherein said primary combustion chamber comprises a generally horizontal refractory tubular member.

3. the furnace construction of claim 1 further comprising sealing means for providing sealing of said afterburner chamber under the compressive loading of said vertical tubular members in conjunction with said manifolds.

4. The furnace construction of claim 1 further comprising a refractory cast primary combustion chamber.

5. The furnace construction of claim 1 wherein said primary combustion chamber includes an ash removal means for enabling removal of ash from the products of combustion of said primary combustion chamber.

6. The furnace construction of claim 1 further comprising means for introducing solid waste feed into said primary combustion chamber and means for removing ash from said primary combustion chamber.

7. The furnace construction of claim 1 wherein said manifolds are constructed of at least two separately cast individual portions, one of said portions including a pair of apertures therein in which the ends of a pair of said tubular members are received.

8. The furnace construction of claim 7 wherein said manifolds are constructed of three portions, a further one of said portions including a connecting chamber providing communication between said pair of tubes and said three portions being stacked vertically and being joined by ship-lap joints.

9. The furnace construction of claim 7 wherein a further one of said portions includes a removable port received therein.

10. The furnace construction of claim 9 wherein said removable port includes a sight glass therein.

11. The furnace construction of claim 7 wherein one of said manifolds includes a pipe received therein, said pipe being disposed in said manifold in communication with one of said tubular members.

12. The furnace construction of claim 11 wherein the free end of said pipe is connected to an oxygen analyzer.

13. The furnace construction of claim 1 wherein said primary combustion chamber and said tubular members are housed within a sealed shell, and said furnace includes a blanket insulation between said tubular members and said primary combustion chamber, and said shell.

14. The furnace construction of claim 1 further comprising girdle heaters surrounding said tubular members for heating the same.

15. The furnace construction of claim 1 further comprising plate heaters for heating said manifolds.

16. The furnace construction of claim 15 wherein said plate heaters are spaced from the surfaces of said manifold which are being heated.

17. The furnace construction of claim 2 further comprising feeding means for feeding waste material to said furnace, said feeding means including ram means for injecting waste into said primary chamber.

18. The furnace construction of claim 17 wherein said ram means includes a ram body having a longitudinally extending prow extending outwardly from the front thereof.

19. The furnace construction of claim 17 wherein said raw means includes a ram body and motor means for moving said ram body longitudinally and for rotating said ram body.

20. The furnace construction of claim 1 further comprising air mixing means located in said one tubular member for mixing air with the gases received from said primary combustion chamber.

21. The furnace construction of claim 20 wherein said air mixing means includes a housing having an inner surface perforate conical shell mounted therein with the small end thereof disposed toward said primary combustion chamber and means for feeding air into said housing.

22. The furnace construction of claim 17 wherein said feeding means further comprises a rotary magazine feeder for feeding said ram.

23. The furnace construction of claim 22 wherein said feeding means further includes a double valve loading mechanism and a plurality of fluid inlets located between said magazine feeder and said ram means.

24. The furnace construction of claim 1 further comprising an ash removal assembly disposed beneath the said one tubular member, said ash removal assembly including a storage chamber and knife valve means for controlling the transfer of solid products of combustion from the primary combustion chamber relative to said storage chamber.

25. A furnace for the incineration of contaminated waste material, said furnace comprising, in combination:

a. a primary combustion chamber comprising a generally horizontal refractory tubular means, said member including a waste feed means at one end thereof;

b. a continuous afterburner chamber comprising a plurality of generally vertical refractory tubular members disposed in spaced parallel relationship, and a plurality of cast refractory manifolds for connecting said tubular members together serially to define a continuous tortuous path within said afterburner chamber, one of said vertical members being disposed adjacent to said primary combustion chamber, and being connected thereto;

c. off-gas removal means connected to the last of said vertical tubular members in the serial connection;

d. heater means surrounding said primary combustion chamber and said afterburner chamber;

e. insulation surrounding said chambers;

f. means for enclosing and supporting said insulation and said chambers; and g. means for maintaining subatmospheric pressure in said chambers.

* * * * *